United States Patent [19]

Galbreath

[11] 4,447,172

[45] May 8, 1984

[54] ROADWAY EXPANSION JOINT AND SEAL

[75] Inventor: Richard N. Galbreath, Wilsons, Va.

[73] Assignee: Structural Accessories, Inc., Lenoir, N.C.

[21] Appl. No.: 359,216

[22] Filed: Mar. 18, 1982

[51] Int. Cl.[3] ..... E01C 11/04

[52] U.S. Cl. ..... 404/68; 404/65; 52/396

[58] Field of Search ..... 404/68, 64, 65, 66, 404/67, 47; 14/16.5; 52/396, 403; 49/475; 277/166, 167.5, 212 R, 212 F, 212 FB

[56] References Cited

U.S. PATENT DOCUMENTS

| | | | |
|---|---|---|---|
| 1,961,077 | 5/1934 | Pater | 404/66 |
| 3,575,094 | 4/1971 | Hewitt et al. | 404/65 |
| 3,626,822 | 12/1971 | Koster . | |
| 3,850,539 | 11/1974 | Bowman et al. . | |
| 3,888,599 | 6/1975 | Reifsnyder . | |
| 3,977,802 | 8/1976 | Galbreath . | |
| 3,981,601 | 9/1976 | Arai . | |
| 3,994,609 | 11/1976 | Puccio . | |
| 4,018,539 | 4/1977 | Puccio . | |
| 4,067,660 | 1/1978 | Puccio . | |
| 4,111,583 | 9/1978 | Brady et al. | 14/16.5 X |
| 4,119,387 | 10/1978 | Brown | 14/16.5 X |
| 4,148,167 | 4/1949 | Puccio . | |
| 4,179,226 | 12/1979 | Puccio . | |
| 4,210,698 | 7/1980 | Watson | 404/64 X |
| 4,295,315 | 10/1981 | Lynn-Jones et al. | 404/69 X |
| 4,305,680 | 12/1981 | Rauchfuss, Jr. . | |

FOREIGN PATENT DOCUMENTS 586790 4/1977 Fed. Rep. of Germany .

*Primary Examiner*—Ernest R. Purser
*Assistant Examiner*—Beverly E. Hjorth
*Attorney, Agent, or Firm*—Bell, Seltzer, Park & Gibson

[57] ABSTRACT

A roadway expansion joint and seal is disclosed which comprises a pair of parallel metal side rails having a flexible elastomeric membrane secured therebetween. The membrane includes enlarged opposite edge portions which are solid in cross section, and which are mounted within respective C-shaped sockets in the side rails. The edge portions include a recess in the outwardly facing surface thereof and which defines a pocket between the edge portion and the inner wall of the C-shaped socket. The recess is sized and positioned to permit the edge portion to laterally flex to facilitate assembly thereof into its associated socket, and also, the pocket is adapted to be filled with an adhesive material to securely maintain the assembly of the membrane and side rails. In addition, the membrane includes a central web portion which is configured to accommodate relative movement of the side rails.

12 Claims, 10 Drawing Figures

15
14
32
22
21
20
19
45
50
18
16
34
33
11
12
23
34a
33a
32a
48
34b
33b
32b
49
40
43
42
36
38
41
H
R
D

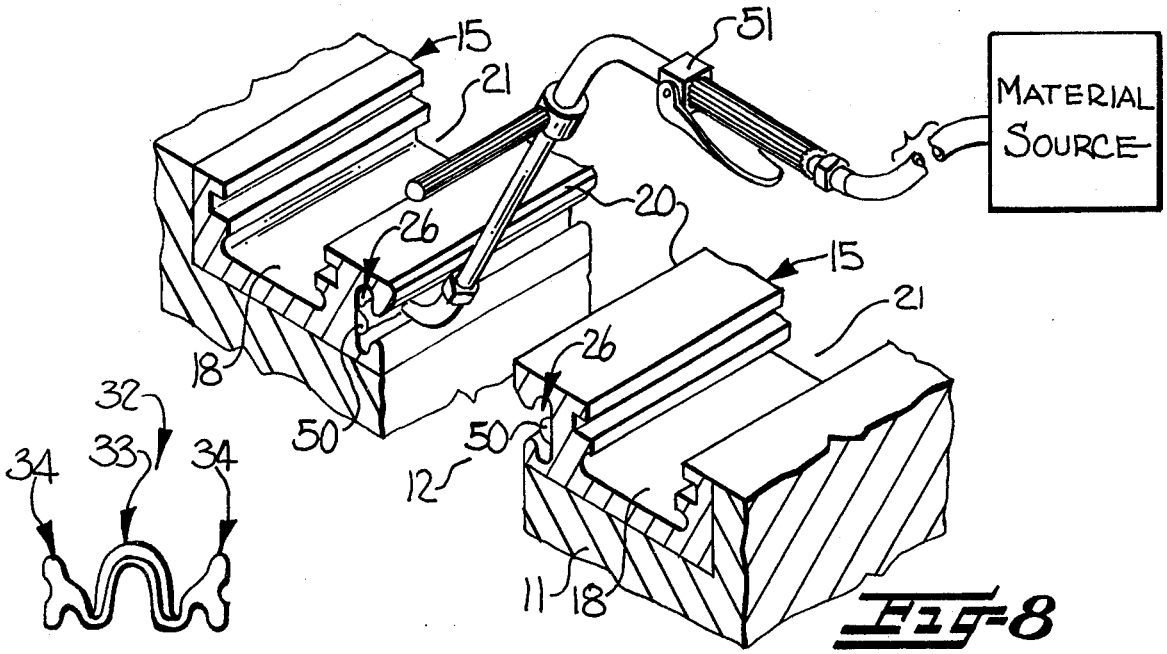
Fig-8
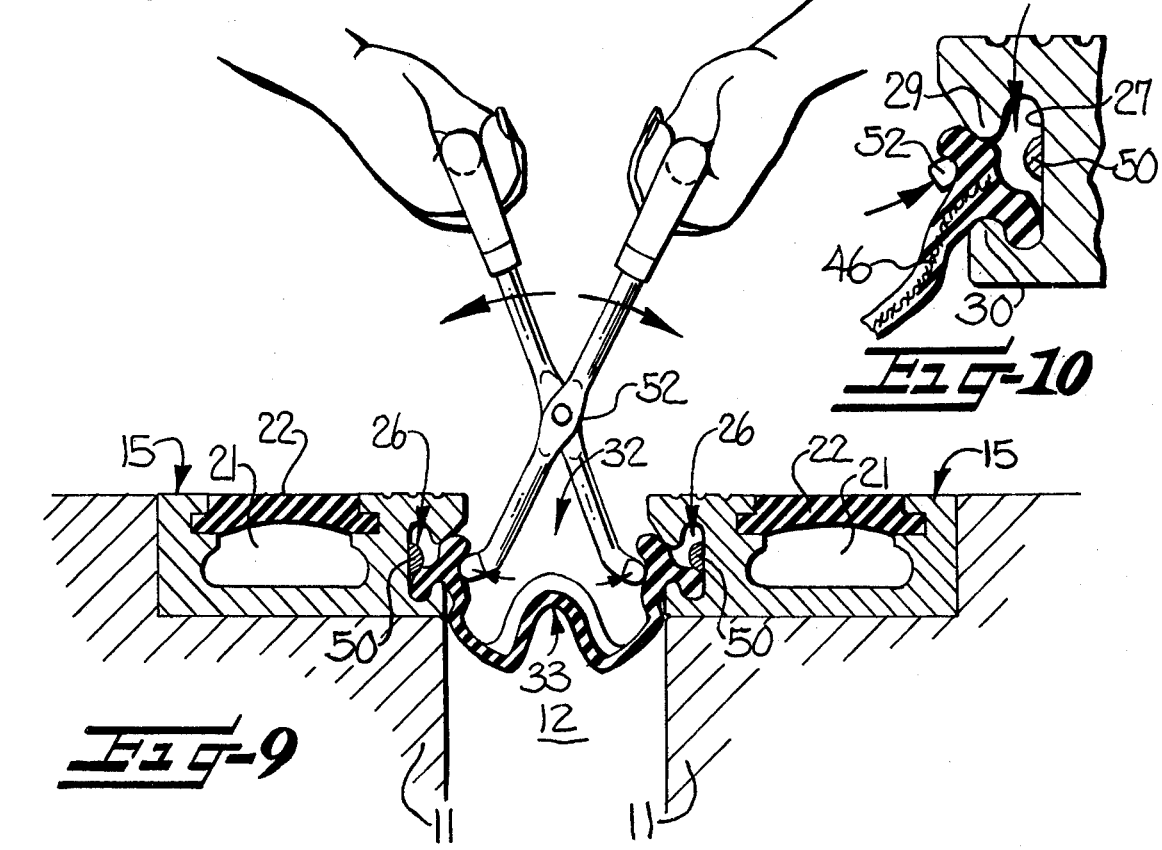
Fig-7
Fig-10
Fig-9

ROADWAY EXPANSION JOINT AND SEAL

The present invention relates to a roadway expansion joint which is adapted to span and seal the expansion gap between adjacent structural members, such as adjacent roadway sections in bridges, parking decks, overpasses, and the like.

It is well known that elevated roadways and other structural members are not static, but move with respect to their foundations as a result of a number of conditions, including temperature changes, the passage of traffic, or the uneven settling of the foundation. To compensate for this relative movement, such roadways are constructed in sections which are independently supported for relative movement and whose adjacent edges are spaced apart to thereby define a gap between the sections which accommodates such relative movement. These gaps are commonly referred to as "expansion gaps" and usually extend transversely across the roadway, but in the case of multilane elevated highways of the like, its common for one or more gaps also to extend in the direction of traffic flow.

Various expansion joint structures have been proposed for the purpose of providing a substantially uninterrupted road surface across these gaps, and to prevent water or debris from falling through the gaps onto underlying structures. One such expansion joint structure is illustrated in the U.S. Pat. No. 4,305,680, to Rauchfuss, and comprises a pair of longitudinally extending metal side rails mounted along the respective top side edges of the adjacent roadways sections, and with an elongate flexible membrane mounted between the rails to close or span the gap. To interconnect the rails and membrane, there is provided a socket of generally C-shaped cross-sectional configuration formed in each of the opposing faces of the rails, and the membrane includes enlarged hollow, opposite side edge portions which are mounted within respective ones of the C-shaped sockets. The membrane is assembled to the rails by initially applying a lubricating adhesive to the edges of the membrane and to the sockets of the metal rails, and then laterally forcing the edges into the sockets of the rails. The fact that the side edge portions are hollow permits the same to collapse and pass through the narrow entrance portion of the socket. Once in the socket, each side edge portion expands to its original configuration to substantially fully occupy the socket and such that each edge portion is retained behind the narrow entrance portion thereof.

While expansion joints of the above type are in commercial use and function satisfactorily, the extent of their use has been restricted by reason of several disadvantages. In particular, the membrane of the above described expansion joint must normally be fabricated by an extruding operation in order to form the hollow edge portions thereof. Extruding is a relatively costly operation which requires expensive equipment, and it is difficult to maintain close material tolerances in the resulting product. Also, the fact that the membrane must be extruded renders it difficult if not impossible to incorporate fabric reinforcement, or to form complex cross-sectional configurations, such as a corrugated arch of the type illustrated in applicant's prior U.S. Pat. No. 3,977,802. Further, in forming unique or unusual formations, such as horizontal skews, vertical risors, or vertical laybacks, it is desirable to join the ends of two membrane segments by vulcanization, but the presence of the hollow edge portions precludes such vulcanization since the attendant heat and pressure will act to fill the hollow voids.

It is accordingly an object of the present invention to provide an expansion joint and seal of the described type and which utilizes a membrane which may be molded rather than extruded, to thereby avoid the disadvantages of the above prior constructions.

It is a more particular object of the present invention to provide a membrane having enlarged ear-like edge portions which are solid in cross section, and which are adapted to be inserted into and then retained in cooperating sockets of the side rails, and which lend the membrane to vulcanization to facilitate fabrication of unique or unusual formations.

It is also a particular object of the present invention to provide a configuration for the ear-like edge portions of the membrane which permits the edge portions to flex to facilitate insertion into the cooperating socket of the side rail, and which also defines a pocket within the socket for receiving an adhesive to secure the edge portion therewithin.

These and other objects and advantages of the present invention are achieved in the embodiments illustrated herein by the provision of a roadway expansion joint and seal which comprises a pair of parallel, laterally spaced apart side rails, with the rails having opposed faces and a socket of generally C-shaped cross-sectional configuration formed in each of the opposing faces and extending along the length of the rail. Each of the sockets includes a generally flat inner wall, with the inner walls of the two sockets being generally parallel to and facing each other. An elongate flexible membrane extends between the rails and comprises a web portion, and an ear-like edge portion extending along each side of the web portion. Each edge portion is solid in cross section and is mounted within and substantially conforms to the configuration of respective ones of the sockets, and each includes an outer surface which is in direct opposing contact with the inner wall of the associated socket. In addition, the outer surface of each edge portion includes a recess defining a pocket between the edge portion and the inner wall of the socket. Each of the recesses is disposed at a medial location along the transverse dimension of the edge portion and is of a size sufficient to permit the edge portion to laterally flex to facilitate its assembly into the associated socket.

In a preferred embodiment, the pockets formed between the edge portion and inner wall of the sockets are each substantially filled with an elastomeric adhesive to securely retain the edge portion in the socket. More particularly, upon the setting of the adhesive, the pockets will be essentially filled with a relatively solid material which acts to rigidify the edge portions and limit their ability to flex, and thereby substantially preclude undesired withdrawal of the edge portions from the sockets. Also, the web portion is integrally joined to each edge portion on the side thereof opposite its outer surface, and at a medial location along the transverse dimension thereof so as to be laterally aligned with the recess. Further, the web portion includes a wall segment immediately adjacent each edge portion, with each wall segment having an upper surface which is generally flat and inclined in a direction of increasing thickness toward the adjacent edge portion, and such that the flat surface is adapted to provide a bearing surface for engagement by a suitable tool during insertion of the edge portion into its associated socket. Also, the inclined surfaces act to upwardly eject rocks and the like from the joint, during the normal periodic movement of the side rails toward each other, and the web portion preferably includes a V-shaped configuration, or one or more arches, to accommodate relative movement of the adjacent side rails and structural members.

Some of the objects having been stated, other objects and advantages will appear as the description proceeds, when taken in connection with the accompanying drawings in which—

FIG. 7 is an end elevation view of a further embodiment of a membrane in accordance with the present invention;

FIG. 8 is a fragmentary perspective view illustrating an initial step in a method by which the edge portions of the membrane of the joint and seal may be secured within the sockets of the side rails;

FIG. 9 is an end elevation view illustrating a subsequent step in the assembly operation; and FIG. 10 is a fragmentary end elevation view illustrating the manner in which the edge portion of the membrane flexes during the asembly operation.

Figures 1, 2, 3, 4, 5, 6:
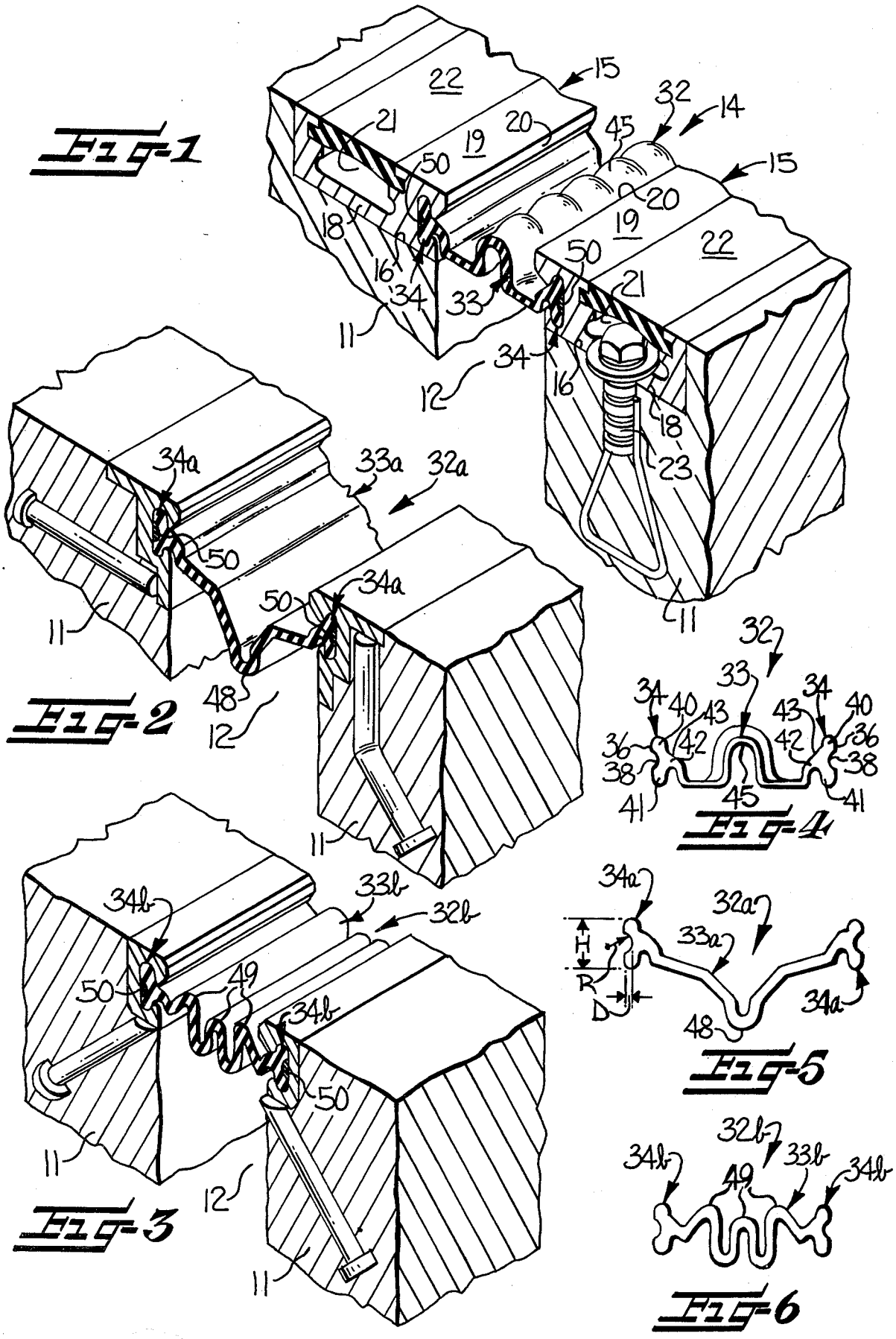
FIG. 1 is a sectioned perspective view of adjacent roadway sections of a bridge or the like, and which incorporates an expansion joint and seal embodying the features of the present invention.
FIG. 2 is a view similar to FIG. 1 and illustrating a second embodiment of the invention.
FIG. 3 is a view similar to FIG. 1 and illustrating another embodiment of the present invention.
FIGS. 4, 5 and 6 are end elevation views of the membrane of the expansion joint and seal illustrated in FIGS. 1, 2, and 3 respectively.

Referring more specifically to the drawings, FIG. 1 illustrates adjacent roadway sections 11 having an expansion gap 12 therebetween. An expansion joint and seal 14 is positioned along the top edges of the roadway sections to span and seal the gap. More particularly, the joint and seal 14 comprises a pair of longitudinally extending side rails 15 disposed in a parallel, laterally spaced-apart relationship. The side rails 15 are preferably fabricated from a suitable metallic material, such as aluminum or steel, and they may be formed in the indicated cross-sectional configuration by an extrusion process, or by welding. In the embodiment of FIG. 1, the rails 15 are disposed along rectangular ledges 16 which extend along the adjacent edges of the roadway sections. The rails 15 include a bottom wall 18 resting upon the bottom surface of the ledge 16, an upper surface 19 which is co-planar with the roadway surface, opposing edge faces 20, and an open longitudinal channel 21 positioned along the rear edge and which is covered by a suitable elastomeric plate 22. The rails 15 are anchored in the ledges 16 by means of anchor bolts 23 which are positioned along the edges of the roadway sections, and which extend through apertures in the bottom wall 18 of each rail.

As best seen in FIG. 10, a socket 26 of generally C-shaped cross-sectional configuration is formed in each of the opposing faces 20 of the rails, with the sockets 26 extending along the length thereof. Each of the sockets 26 includes the generally flat, inner wall 27, with the inner walls of the two sockets being generally parallel to and facing each other. The sockets 26 also each define upper and lower retaining lips 29 and 30 respectively.

An elastomeric flexible membrane 32 extends longitudinally between the rails 15 and spans the space therebetween. The membrane 32 comprises a central web portion 33 and a pair of integral ear-like enlarged edge portions 34 extending along respective sides of the web portion. The edge portions 34 are solid and mirror images of each other in cross-section, and each edge portion extends outwardly in the transverse or upright direction beyond the adjacent web portion on each side thereof. Further, each edge portion 34 includes an outer surface 36 which faces in a direction away from the web portion, with the outer surface including an arcuately curved recess 38 disposed at a medial location along the transverse dimension thereof. The recess 38 thus divides the edge portion into upper and lower beads 40 and 41 respectively. As further described below, the recess 38 is of a size sufficient to permit the upper bead 40 to laterally flex to facilitate the assembly of the edge portion into the receiving socket 26 of the rail, note FIG. 10.

The web portion 33 is joined to each edge portion 34 on the side thereof opposite its outer surface, and at a medial location along the transverse or upright dimension thereof, so as to be laterally aligned with the recess 38. Further, the web portion includes a wall segment 42 immediately adjacent each edge portion, with each wall segment having an upper srface 43 which is generally flat and inclined in a direction of increasing thickness toward the adjacent edge portion. Also, it will be seen that the wall segments 42 do in fact increase in thickness in a direction toward the associated edge portion, to provide increased strength at the joint.

The recess 38 in each edge portion 34 is preferably arcuately curved in cross-section, and has a depth equal to about one-half its transverse dimension. Further, the transverse dimension of the recess is preferably at least about one-third the transverse dimension of the edge portion. In one specific example, the edge portion had an overall transverse dimension or height H (note FIG. 5) of one inch, and the recess had a radius of curvature R of 0.250 inches and a depth D of 0.125 inches. The center of the radius of curvature was located 0.438 inches from the top of the edge portion as seen in FIG. 5.

In order to permit the expansion joint and seal to accommodate relative movement of the roadway sections, the web portion 33 of the embodiment of the membrane illustrated in FIGS. 1 and 4 includes an integral arch 45 positioned intermediate the edge portions so as to be adapted to be disposed within and extend longitudinally along the expansion gap 12. The arch 45 extends outwardly from the remainder of the web portion in the transverse or upright direction and has a corrugated configuration with the corrugations thereof extending in a lateral direction, to thereby impart substantial flexibility to the membrane and such that the membrane is able to accommodate the relative movement of the adjacent roadway sections. A further description of the corrugated configuration of the arch may be found by reference to applicant's prior U.S. Pat. No. 3,977,802.

The membrane 32 is preferably molded from a suitable elastomeric material, such as EPDM or Neoprene. In addition, a reinforcing fabric 46 (FIG. 10) or fibers may be embedded in the membrane to protect against rupture or tearing. The reinforcing fabric is preferably of a somewhat resilient, stretchable construction, such as a knit fabric, and also is preferably constructed from strong, non-wetting yarns or fibers, such as glass or a suitable polymer such as nylon or polyester, to prevent deterioration of the fabric in the event of contact with water or moisture.

In the embodiment of FIGS. 2 and 5, the web portion 33*a* of the membrane 32*a* is in the form of a relatively shallow V in cross section, and includes a longitudinal fold line 48 or arch at the apex of the V to accommodate relative movement of the structural members. In the embodiment of FIGS. 3 and 6, the web portion 33*b* of the membrane 32*b* has a cross-sectional configuration which includes a plurality of arches 49 which extend in the longitudinal direction, to accommodate the relative movement. The embodiment of FIG. 7 is generally similar to that of FIGS. 1 and 4, but the membrane is of somewhat reduced width.

The steps involved in a preferred method for assembling the membrane 32 into the sockets 26 of the side rails are illustrated schematically in FIGS. 8 and 9. Initially, the rails 15 are assembled in the ledges 16 of the adjacent roadway sections, and a line of a suitable adhesive material 50 is then applied along the inner wall 27 of the two sockets, utilizing a suitable hand held applicator 51. Next, the lower bead 41 of the enlarged edge portions are inserted into the sockets as seen in FIG. 9, and a suitable tong-like tool 52 is positioned to engage the flat surfaces 43 of the web portions. Upon expanding the tool, the arms thereof cause the upper beads 40 of the edge portions to flex along the line formed between the recess 38 and the juncture of the surface 43 and bead 40, note FIG. 10. The upper beads 40 are thereby slipped into the sockets 26, and the entire edge portion is thus locked behind the upper and lower lips 29, 30 of the sockets. In assembled relation, the adhesive material 50, which may consist of a conventional lubricating adhesive or rubber-like caulking material, fills the pocket formed between the recess 38 and the inner wall 27 of the socket. Upon setting, the adhesive assists in securely retaining the assembly of the membrane and rails. More particularly, since the pockets are then filled with a relatively rigid or solid adhesive material, the effective cross-sectional area of the edge portions within the sockets is increased and the ability of the edge portions to flex is thereby limited. Thus the flexure required to withdraw the edge portions from the sockets is effectively precluded. It will also be appreciated that the adhesive may also be initially positioned on the outer surface 36 of the edge portions to serve as a lubricant during the assembly operation and thus facilitate insertion of the edge portions into the sockets.

While the illustrated assembly operation involves initially securing the rails to the roadway sections 11, it will be appreciated that the membrane could as well be joined to the two rails prior to the rails being secured to the roadway sections.

In the drawings and specification, there has been set forth a preferred embodiment of the invention, and although specific terms are employed, they are used in a generic and descriptive sense only and not for purposes of limitation.

That which is claimed is:

1. An expansion joint and seal adapted to span and seal adjacent structural members such as adjacent roadway sections and the like, and comprising a pair of longitudinally extending side rails disposed in a parallel, laterally spaced-apart relationship, said rails having upper surfaces, opposing faces, and a socket of generally C-shaped cross-sectional configuration formed in each of the opposing faces and extending along the length of the rails, each of said sockets including a generally flat inner wall, an elongate flexible membrane extending longitudinally between the rails and spanning the space therebetween, said membrane comprising a central web portion and ear-like transverse edge portions extending outwardly along respective sides of the web portion, each of said edge portions being solid in cross-section and mounted within and substantially conforming to the internal configuration of respective ones of said C-shaped sockets, and including an outer surface having a portion in direct opposing contact with the inner wall of the associated socket and a recess formed in the outer surface and defining a pocket between the edge portion and said inner wall which extends along the length of the membrane and side rails, each of said recessed being disposed at a medial location along the transverse dimension of the edge portion and being of a size sufficient to permit the edge portion to laterally flex to facilitate assembly thereof into the associated socket, said web portion being joined to each edge portion on the side thereof opposite its outer surface and at a medial location along the transverse dimension thereof and so that each edge portion extends outwardly in the transverse direction beyond the adjacent web portion on each side of the edge portion.

2. The joint and seal as defined in claim 1 wherein said membrane comprises an elastomeric material and is solid throughout its cross section.

3. The joint and seal as defined in claim 2 wherein the recess in cross section is arcuately curved and has a depth equal to about one half its transverse dimension.

4. The joint and seal as defined in claim 3 wherein the transverse dimension of said recess is at least about one third the transverse dimension of said edge portion.

5. The joint and seal as defined in claim 4 wherein said web portion includes a wall segment immediately adjacent each edge portion, with each wall segment having an upper surface which is generally flat and inclined so that the thickness of said wall segment increases in a direction toward the adjacent edge portion, and such that the flat upper surface is adapted to provide a bearing surface for engagement by a suitable tool during insertion of the edge portion into its associated socket.

6. The joint and seal as defined in any one of claims 1–5 wherein each of said pockets is substantially filled with an adhesive material, and whereby the adhesive material in the pockets effectively serves to increase the cross-sectional area of the edge portions and rigidifies the edge portions to limit the flexure thereof and thereby substantially preclude undesired withdrawal of the edge portions from the sockets.

7. The joint and seal as defined in any one of claims 1–5 wherein the inner walls of the two sockets are generally parallel to and face each other.

8. An elastomeric membrane adapted to extend across and sealingly close a longitudinally extending expansion gap between adjacent structural members, said membrane comprising a central web portion and a pair of integral ear-like transverse edge portions extending outwardly along respective sides of said web portion, said edge portions being solid and mirror images of each other in cross section, with each edge portion extending outwardly in the transverse direction beyond the adjacent web portion on each side thereof, and including an outer surface facing in a direction away from said web portion, said outer surface including a curved recess disposed at a medial location along the transverse dimension thereof, and being of a size sufficient to permit the edge portions to laterally flex to facilitate assembly thereof into a receiving socket or the like.

9. The elastomeric membrane as defined in claim 8 wherein said membrane is solid throughout its cross section and said web portion includes an integral arch positioned intermediate the pair of side edges so as to be adapted to be disposed within and extend longitudinally along the expansion gap, said arch extending outwardly from the remainder of the web portion in the transverse direction and having a corrugated configuration with the corrugations thereof extending in a lateral direction to thereby impart substantial flexibility to the membrane such that the membrane is able to accommodate relative movement of the structural members.

10. The elastomeric membrane as defined in claim 8 wherein said membrane is solid throughout its cross section and the cross sectional outline of said portion is in the form of a relatively shallow V, and includes a longitudinal fold line at the apex of the V to accommodate relative movement of the structural members.

11. The elastomeric membrane as defined in claim 8 wherein said membrane is solid throughout its cross section and the cross sectional configuration of said web portion includes a plurality of longitudinally extending arches to accommodate relative movement of the structural members.

12. The elastomeric membrane as defined in any one of claims 8–11 wherein the elastomeric membrane includes a fabric reinforcement embedded therein.

* * * * *